US007712740B2

(12) United States Patent
Acton et al.

(10) Patent No.: US 7,712,740 B2
(45) Date of Patent: May 11, 2010

(54) EXIT SHAFT DAMPENING DEVICE TO IMPROVE PRINT QUALITY

(75) Inventors: Larry W. Acton, London, KY (US); William M. Connors, Lexington, KY (US); Walter K. Cousins, Lexington, KY (US); Stephen E. Stewart, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 444 days.

(21) Appl. No.: 11/268,929

(22) Filed: Nov. 8, 2005

(65) Prior Publication Data

US 2007/0102871 A1 May 10, 2007

(51) Int. Cl.
*B65H 29/20* (2006.01)

(52) U.S. Cl. ..... 271/314; 188/67

(58) Field of Classification Search ..... 271/272, 271/275, 314; 347/104; 188/67
See application file for complete search history.

(56) References Cited

U.S. PATENT DOCUMENTS 2,317,481 A * 4/1943 Peterson et al. ..... 74/164
3,576,322 A * 4/1971 Goplen ..... 271/117
3,904,192 A * 9/1975 Pfeifer et al. ..... 271/186
4,197,024 A 4/1980 Huntoon
4,513,959 A * 4/1985 Kindt ..... 271/270
4,569,514 A * 2/1986 Holtje ..... 271/314
4,876,613 A 10/1989 Honda
5,645,275 A 7/1997 Tranquilla
5,959,642 A 9/1999 Fujioka et al.
6,007,063 A * 12/1999 Park ..... 271/273
6,453,140 B1 9/2002 Hsu
6,769,683 B2 8/2004 Hiramatsu
2002/0135122 A1 9/2002 Hiramatsu
2003/0001334 A1 1/2003 Hoberock
2003/0098984 A1 5/2003 Botten et al.
2003/0141654 A1 7/2003 Nishikata et al.
2004/0188928 A1 * 9/2004 Tanabe ..... 271/207

* cited by examiner

*Primary Examiner*—Patrick Mackey
*Assistant Examiner*—Michael C McCullough
(74) *Attorney, Agent, or Firm*—James E. Cole; John Victor Pezdek

(57) ABSTRACT

The present invention includes a damping device for a media feed mechanism for a peripheral device having a media feed-path having a feed shaft and a downstream exit shaft. In one form a damping hub is mounted on said exit shaft, a resilient biasing member extending between the damping hub and the feed shaft to create a damping force on the damping hub. In another embodiment damping is provided by a brake structure engaging said damping hub. In yet another embodiment, a brake structure is pivotably mounted.

4 Claims, 8 Drawing Sheets

EXIT SHAFT DAMPENING DEVICE TO IMPROVE PRINT QUALITY

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Invention

The present invention relates generally to media feed mechanisms, and more particularly to inhibiting media nip jump and rollback induced banding at the exit shaft.

2. Description of the Related Art

All-in-one machines typically perform functions such as printing, scanning, copying, and faxing in either a stand alone fashion or in conjunction with a personal computer and define a growing market for peripheral devices. These devices eliminate clutter in a business or home office by combining the desirable functionality of various machines into a single unit, while maintaining an affordable cost. Various all-in-one machines currently in the marketplace use thermal inkjet technology as a means for printing received fax documents, original documents, and copied or scanned images or text. Thermal inkjet printing devices utilize consumable inkjet cartridges in fluid communication with a printhead to record text and images on a print media. The printhead typically moves on a carriage relative to the media path and a control system activates the printhead to selectively eject ink droplets onto the print media.

The all-in-one devices utilize feed mechanisms configured to move sheets sequentially from the input tray, through a printing component and to an exit tray. Thus, feed mechanisms may include many parts which provide for media movement. Many feed mechanisms include drive transmissions which convert motor rotation into roller and shaft rotation to move media through the media path. The media is advanced in preselected steps or distances, also known as indexing, in order to properly form a printed image. Typically, these drive transmissions are gear drives, which require a necessary amount of tooth clearance, called backlash, for proper operation. Backlash is the amount of clearance between mated gear teeth in a gear pair. When media is passing through the printing component, any unintended advancement of media may result in print defects, such as banding or the like. Unfortunately, since proper gear design requires some backlash, unintended media movement is a continual problem. Some backlash is required to allow for lubrication, manufacturing errors, deflection under load and differential expansion between the gears and the housing. Backlash is created when the tooth thickness of either gear is less than the tooth thickness of an ideal gear, or the zero backlash tooth thickness. For example, standard practice is to make allowance for half the backlash in the tooth thickness of each pair.

During media feeding, at least two phenomenon may cause a printing defect known as banding. The first phenomenon that causes print banding is called media nip jump. When a media trailing edge exits a feed nip between a feed roll and the pressure or idler roll, the media is urged forward in a feed direction. This is due to the downward force of the biased idler roll stepping down from the media surface over the media trailing edge. Specifically, the downward force of the pressure roller causes a component force in the direction of media feed. The phenomenon is more pronounced when thicker media is utilized. Further, as the media disengages the feed system, the exit system becomes the sole driving force on the media. The exit system is typically overdriven, i.e. driven at a faster speed than the feed system, so that the media remains taut. This also causes media jump. The media may advance some undesirable distance corresponding to the backlash of a geartrain driving the feed roller. The result is that media may advance some distance greater than the intended amount.

The second phenomenon causing print defects is exit shaft rolling or rollback. Each time the motor rotates a preselected distance to index media through the feedpath, the motor stops. However, the exit shaft and rollers do not stop at the exact position and time that the motor stops at each indexing movement. This is due to several factors, such as the previously indicated backlash in the gear drive, commutator jump, exit system overdrive and other system tolerances. These tolerances are dampened to a large extent when the media is disposed within both the exit nip and feed nip because the feed system dampens the exit system overdrive and tolerances. However, when the media exits the feed system and is solely influenced by the exit system, the dampening effects of the feed system are lost and banding print defects are more visible to a user.

Given the foregoing, it will be appreciated that achieve benefits derived from overcoming the shortcomings and detriments described previously.

SUMMARY OF THE INVENTION

The present invention solves these problems by providing a damping structure for an exit shaft in order to minimize media jump from the media feed system.

According to a first embodiment, a damping device for a media feed mechanism having media feedpath defined between a feed shaft and a downstream exit shaft comprising a damping hub mounted on said exit shaft, and a resilient biasing member extending between the damping hub and the feed shaft to create a damping force on the damping hub. The damping hub is of a preselected diameter. The exit shaft further comprises at least one exit roller on the exit shaft. The at least one exit roller may be a plurality of exit rollers. The resilient biasing member engages a stationary component disposed between the feed shaft and the exit shaft wherein the stationary component may comprise a motor disposed between the damping hub and the feed shaft. The resilient biasing member elastically bends around the motor.

According to a second embodiment, a damping assembly for a media feedpath comprises a feedpath having a first shaft and a second shaft parallel and downstream from the first shaft, a damping hub is disposed on the second shaft, and a brake structure engages the damping hub wherein the brake structure applies torque on the damping hub to inhibit unintended movement of the second shaft during media feed. The brake structure comprises a first damping arm and a second damping arm, and the first and second damping arms extend around the damping hub. The damping assembly further comprises a biasing member engaging the brake structure and damping movement of the second shaft. The damping assembly further comprises a dampener pivot disposed adjacent the brake structure. The damping arms are pivotally connected to the dampener pivot.

According to a third embodiment, an exit shaft damping assembly for a media feedpath in a peripheral device comprises a damping assembly engaging an exit shaft along the media feedpath, the damping assembly has a damping arm and a biasing member extending from the peripheral device and engaging a damping arm, a brake connecting to the damping arm, and a damping hub extends from at least one exit roller of the exit shaft wherein the brake engages the damping hub and places a torque on the exit shaft. The brake structure further comprises an arm pivotally attached to a fixed structure in said peripheral device. The peripheral device may be a printer or an auto-document feed scanner. The biasing member may be a spring. The exit shaft damping assembly may further comprise a print zone disposed adjacent the exit shaft along the media feedpath and a print cartridge between the exit shaft and a feed shaft.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
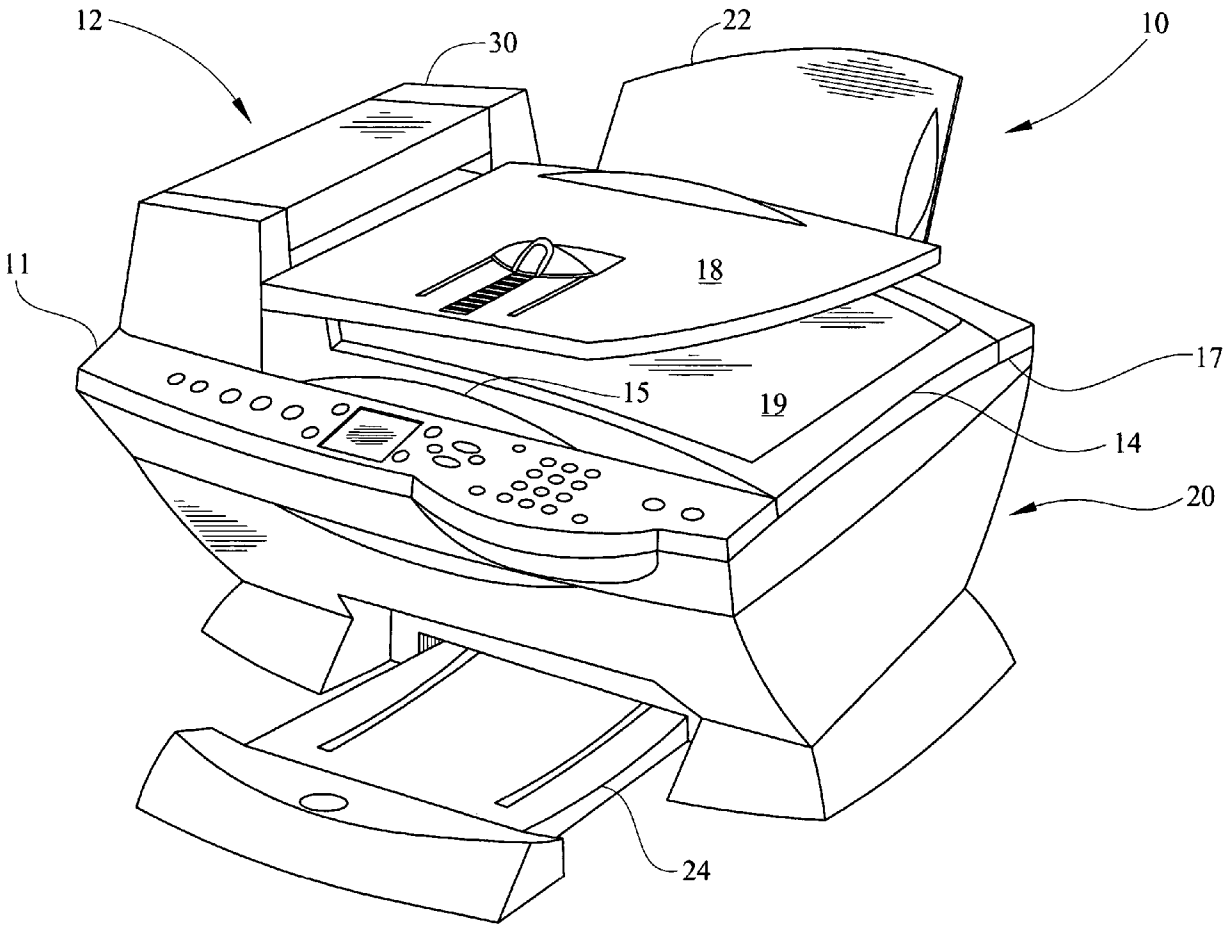
FIG. 1 is a perspective view of an all-in-one device including a printing component.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

The term image as used herein encompasses any printed or digital form of text, graphic, or combination thereof. The term output as used herein encompasses output from any printing device such as color and black-and-white copiers, color and black-and-white printers, and so-called "all-in-one devices" that incorporate multiple functions such as scanning, copying, and printing capabilities in one device. Such printing devices may utilize ink jet, dot matrix, dye sublimation, laser, and any other suitable print formats. The term button as used herein means any component, whether a physical component or graphic user interface icon, that is engaged to initiate input or output.

Referring now in detail to the drawings, wherein like numerals indicate like elements throughout the several views, there are shown in FIGS. 1-8 various aspects of an exit shaft dampening device to improve print quality. The device provides various functions including substantially eliminating media nip jump and exit roller rollback and may be utilized with printing components as well as automatic document feed (ADF) scanners.

Referring initially to FIG. 1, an all-in-one device 10 is shown having an auto-document feeding scanner portion 12 and a printer portion 20, depicted generally by the lower housing portion. The all-in-one device 10 is shown and described herein, however one of ordinary skill in the art will understand upon reading of the instant specification that the present invention may be utilized with a stand alone printer, copier, auto-document feed scanner, or other device utilizing a media feed system. The peripheral device 10 further comprises a control panel 11 having a plurality of buttons for making selections. The control panel 11 may include a graphics display to provide a user with menus, choices or errors occurring with the system.

Extending from the printer portion or component 20 are an input tray 22 at the rear of the device 10 and an exit tray 24 extending from the front of the device 10. A media feedpath 21 (FIG. 3) extends between the input tray 22 and output tray 24 so that the feedpath 21 is substantially L-shaped. The printer portion 20 may include various types of printing mechanisms including a laser printing mechanism or an inkjet printing mechanism. For ease of description, the exemplary printer portion 20 is an inkjet printing device.

Figure 2:
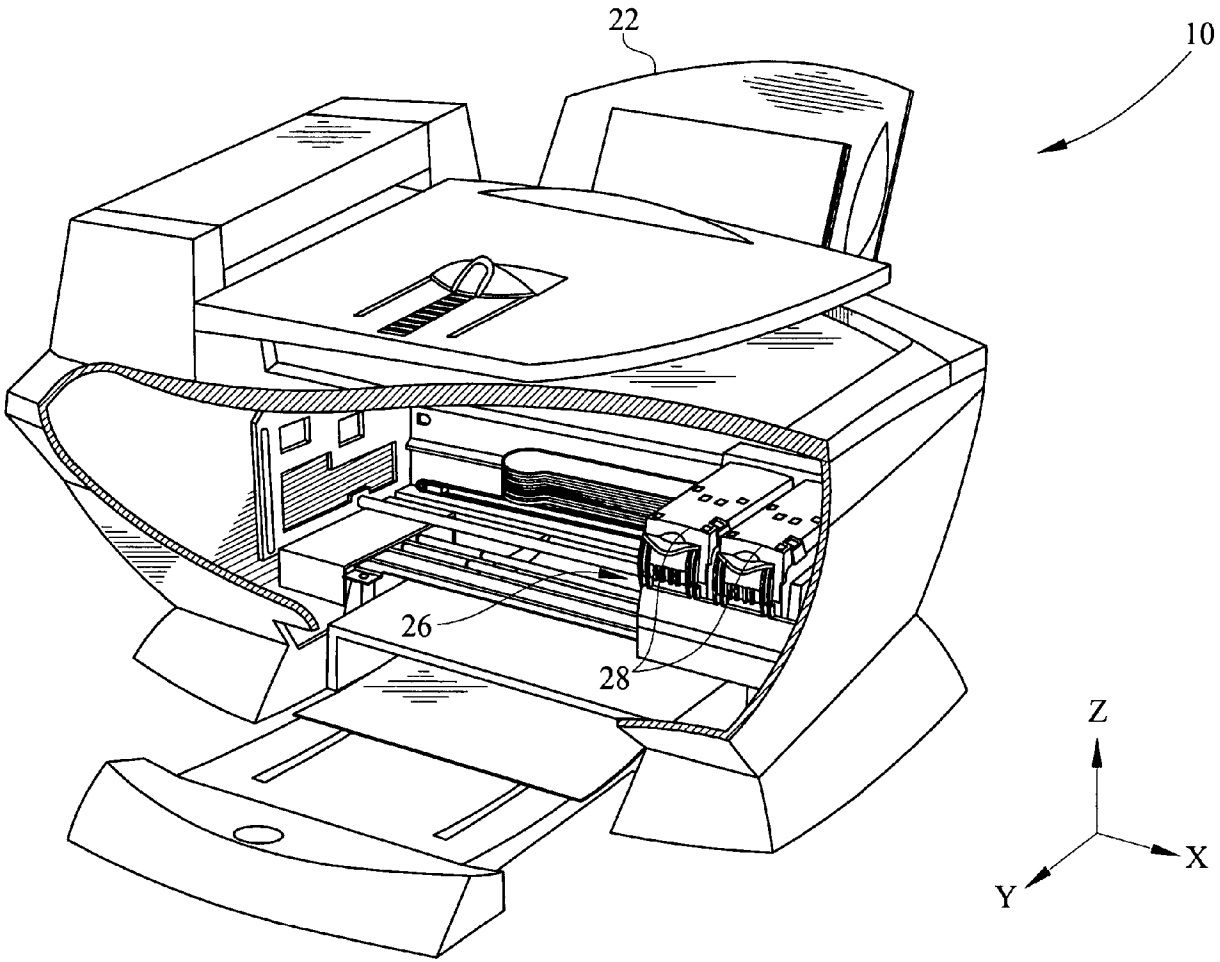
FIG. 2 is a cut-away perspective view of the all-in-one device of FIG. 1 revealing printer components.

Referring now to FIG. 2, an interior cut-away perspective view of the all-in-one device 10 is depicted. With the interior shown, the printing portion 20 includes a carriage 26 having a position for placement of at least one print cartridge 28. FIG. 2 depicts two print cartridges which may be, for instance, a color cartridge for photos and a black cartridge for text printing. The color cartridge may include three inks, i.e., cyan, magenta and yellow inks. Alternatively, a single cartridge may be utilized wherein the three inks, i.e., cyan, magenta and yellow inks are simultaneously utilized to provide the black for text printing in lower cost machines. During advancement media moves from the input tray 22 to the output tray 24 in a substantially L-shaped path along the media feedpath 21 beneath the carriage 26 and cartridges 28. As the media moves into a printing zone, the media moves in a Y-direction as depicted and the carriage 26 and the cartridges move in an X-direction which is transverse to the movement of the media M. As media M passes the cartridges 28, ink is selectively ejected on to the media to form an image.

Referring again to FIG. 1, the scanner portion 12 generally includes an ADF scanner 30, a scanner bed 17 and a lid 14 which is hingedly connected to the scanner bed 17. Beneath the lid 14 and within the scanner bed 17 may be a transparent platen for placement and support of target or original documents for manually scanning. Along a front edge of the lid 14 is a handle 15 for opening of the lid 14 and placement of the target document on the transparent platen (not shown). Adjacent the lid 14 is an exemplary duplexing ADF scanner 30 which automatically feeds and scans stacks of documents which are normally sized, e.g. letter, legal, or A4, and suited for automatic feeding. Above the lid 14 and adjacent an opening in the ADF scanner 30 is an ADF input tray 18 which supports a stack of target media or documents for feeding through the ADF scanner 30. Beneath the input tray 18, the upper surface of the lid 14 also functions as an output tray 19 for receiving documents fed through the ADF scanner 30.

Beneath the ADF scanner 30 is an optical scanning unit having a plurality of parts which are not shown but generally described herein. The scanning unit may comprise a scanning motor and drive which connects the scanning motor and a scanbar. The scanbar is driven bi-directionally along a scanning axis extending in the direction of the longer dimension of a scanner bed. At least one guide bar may be disposed within the scanner bed 17 and may extend in the direction of the scanning axis to guide the scanning bar along the scanning axis. The scanbar moves along the at least one guide bar within the scanner bed 17 beneath the platen. The scanbar has a length which extends in the shorter dimension of the scanning bed. Thus, the scanbar extends across one dimension and moves in a perpendicular dimension to scan an entire surface area of the platen during flatbed scanning. Further, the scanbar may be positioned beneath an ADF window for scanning documents fed through the auto-document feeder where the document is moved past the scanbar. In some duplex scanning arrangements that do not turn over the scanned documents, two scanbars are provided and positioned on opposites of the document. One of the two scanbars may be moveable.

The scanbar may include a lamp, an image sensor, and a mirror therein for obtaining a scanned image from a document. The image sensor may be an optical reduction type image sensor or a contact image sensor (CIS) as is known in the art. In either event, the image sensor then determines the image and sends data representing the image to onboard memory, a network drive, or a PC or server housing, a hard disk drive or an optical disk drive such as a CD-R, CD-RW, or DVD-R/RW. Alternatively, the original document may be scanned by the optical scanning component and a copy printed from the printer component 20 in the case of a multi-function peripheral device 10. The scanbar is generally either an optical reduction type using a combination of lens, mirror and a CCD (Charge Coupled Device) array or CIS array. The CCD array is a collection of tiny, light-sensitive diodes, which convert photons into electrons. These diodes are called photosites—the brighter the light that hits a single photosite, the greater the electrical charge that will accumulate at that site. The image of the document that is scanned using a light source such as a fluorescent bulb reaches the CCD array through a series of mirrors, filters and lenses. The exact configuration of these components will depend on the model of scanner. Some optical reduction scanners use a three pass scanning method. Each pass uses a different color filter (red, green or blue) between the lens and CCD array. After the three passes are completed, the scanner software assembles the three filtered images into a single full-color image. Most optical reduction scanners use the single pass method. The lens splits the image into three smaller versions of the original. Each smaller version passes through a color filter (either red, green or blue) onto a discrete section of the CCD array. The scanner software combines the data from the three parts of the CCD array into a single full-color image.

In general, for inexpensive flatbed scanners CIS arrays are used in the scanbar. CIS arrays replace the CCD array, mirrors, filters, lamp and lens with an array of red, green and blue light emitting diodes (LEDs) and a corresponding array of phototransistors. The image sensor array consisting of 600, 1200, 2400 or 4800 LEDs and phototransistors per inch (depending on resolution) spans the width of the scan area and is placed very close to the glass plate upon which rest the image to be scanned. Another version of the CIS used a single set of red, green and blue LEDS in combination with light pipes to provide illumination of the material to be scanned. When the image is scanned, the LEDs combine to provide a white light source. The illuminated image is then captured by the row of sensors. CIS scanners are cheaper, lighter and thinner, but may not provide the same level of quality and resolution found in most optical reduction scanners. Color scanning is done by illuminating each color type of LED separately and then combining the three scans.

Figure 3:
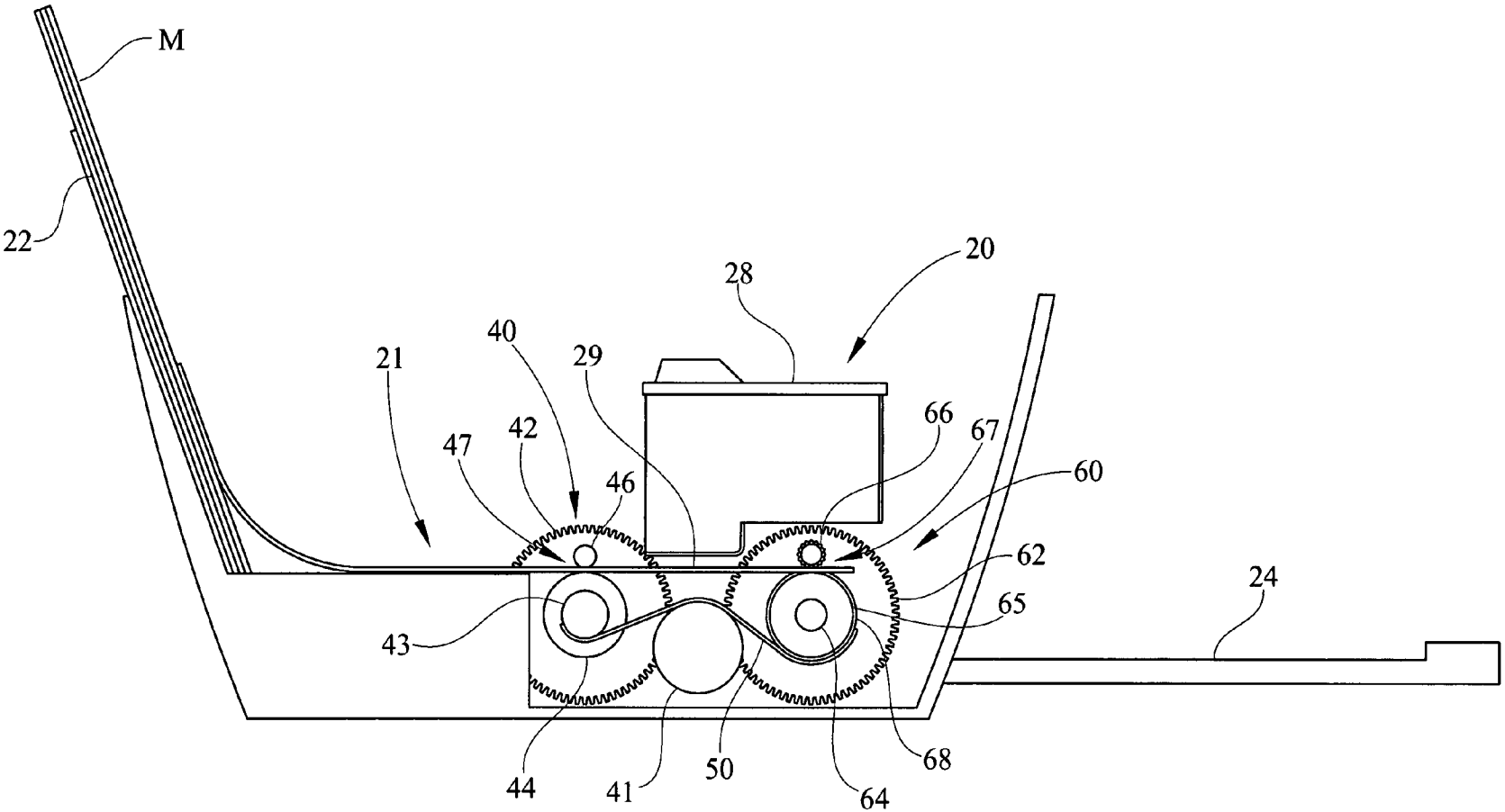
FIG. 3 is a side view of the all-in-one device of FIG. 1 depicting an L-shaped media feedpath.

Referring now to FIG. 3, a side view of the all-in-one device 10 is shown with the scanner 12 removed as well as the upper covers of the device. It should be understood that for purpose of clarity the instant invention is described in use with a printer, however the invention may be utilized with an ADF scanner. Accordingly, the printer component 20 is depicted as well as the media feedpath 21 which extends between the media input tray 22 and the output tray 24. In the area of the print cartridge 28 beneath the feedpath 21 is a motor 41 which drives the media feed system 40, an exit system 60, and an input system. The input system feeds media M from the input tray 22 into the feedpath 21 and may include an auto-compensating mechanism, which is not shown but is known to one skilled in the art. As the media M advances from the input tray 22, the media leading edge reaches the feed system 40 having a feed roller 44 disposed along a feed shaft 43. The feed roller 44 may be a single roller or a plurality of spaced rollers along the feed shaft 43. The feed shaft 43 is connected at one end to a feed gear 42 which is driven, either directly or indirectly, by the motor 41. The feed system 40 further comprises a biased idler roller 46 which may rotatably connected to an idler shaft (not shown). The idler roller 46 is biased toward and in contact with the feed roller 44, which together form a feed nip 47. As the media M is directed into the nip 47, rotation of the feed roller 44 moves the media toward and through the print zone. Thus, the biased idler roller urges the media M toward the feed roller 44 and further causes movement of the media M with the feed roller 44.

Downstream of the feed roller 44 is an exit system 60 comprising an exit shaft 64 having a hub 68 located thereon. The hub 68 has a preselected diameter which is dependent upon the desired torque on the exit shaft 64. As will be understood by one skilled in the art, by increasing the diameter of the hub 68, the torque on the exit shaft will increase and by decreasing the diameter of the shaft 64, the torque will decrease. Connected to the exit shaft 64 is an exit gear 62 which is also driven, either directly or indirectly, by the motor 41. The exit shaft 64 is driven at a faster speed than the feed shaft 43 so that the media M remains taut. The exit shaft 64 also comprises at least one exit roller 65 which is directly beneath an exit star wheel 66. The exit roller 65 and exit star wheel 66 form a nip 67 wherein media is fed and pulled to the output tray 24. Extending between the feed roller 44 and the exit shaft hub 68 is an elastic biasing member 50.

Figure 4:
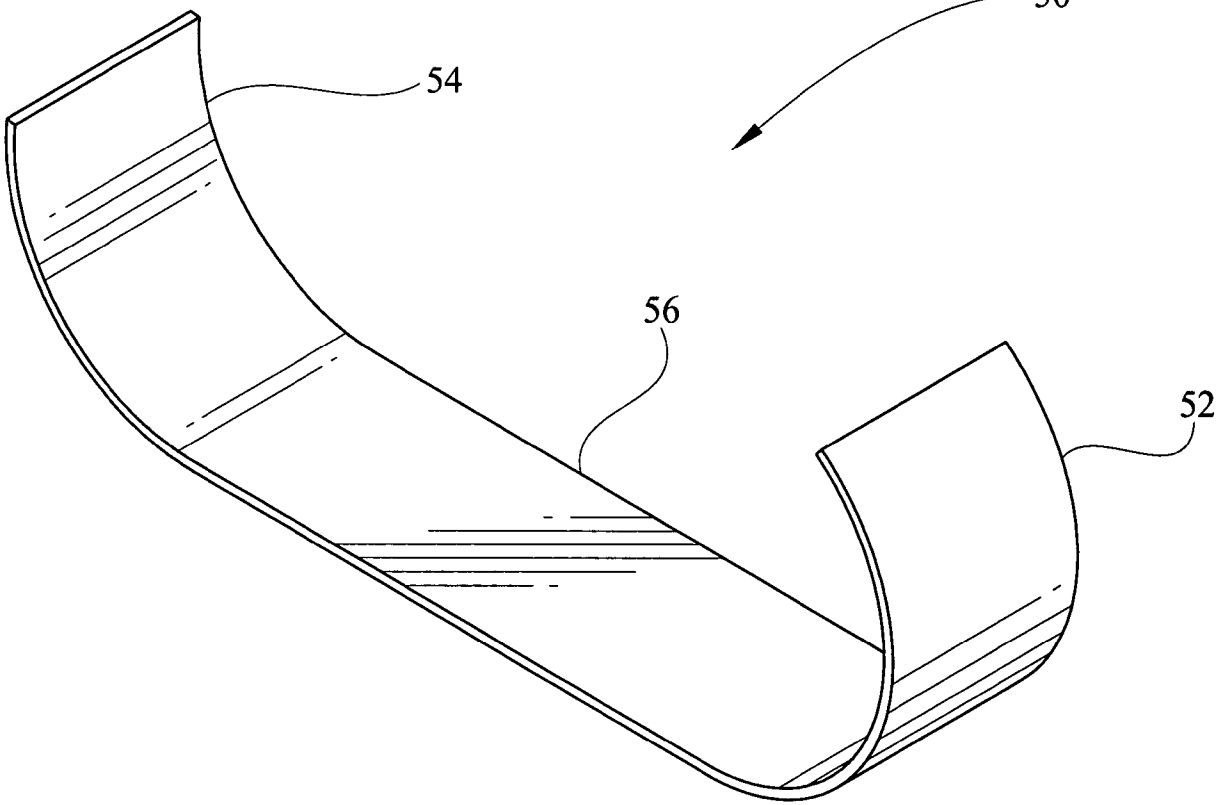
FIG. 4 is a perspective view of a first exemplary dampener.

Referring now to FIGS. 3 and 4, the elastic biasing member 50 is shown in a perspective view in its unbiased position. The elastic biasing member 50 comprises a first bight 52 and an opposed second bight 54 which are connected by a connecting portion 56 to provide the elastic biasing member 50 in a substantially U-shaped appearance. According to the instant embodiment, the elastic biasing member 50 is fanned of metal and has a thickness of between about ⅛ mm and ¾ mm, specifically about ½ mm. Biasing member 50 may have a width of between about 5 mm and 20 mm, specifically about 12 mm. Further, various alternative materials may be used which provide to pro-selected torque on the exit shaft 64. The elastic biasing member 50 may vary in width and thickness depending upon the amount of force that is desired to be placed on the feed roller 44 and exit shaft hub 68. Further, the first and second bights 52, 54 have a pro-selected radius corresponding to the hub 68 and feed roller 44. It should be understood by one skilled in the art that the radius of each bight 52, 54 may vary depending on the parts that the elastic biasing member 50 engages and the desired force on those parts. Specifically, the first bight 52 engages the hub 68 and therefore the first bight 52 has a radius which is sized for the hub 68 to place a pro-selected torque on the hub 68. The biasing member 50 may provide about 0 and 10 inch-ounces of torque, however, this value may vary in order to not damage to motor. Thus, the motor must be able to overcome the torque during operation but the torque must be enough to inhibit unintended movement of the exit shaft 64. Likewise, the second bight 54 engages the feed roller 44 in order to hold the member 50 in place, but may also provide some dampening torque on the feed shaft 43.

In operation, media M is moved from the input tray 22 to the feed system 40 by an input system which may include an auto-compensating mechanism. As the media M advances into the feedpath 21, the leading edge of the media M reaches a nip 47 defined by an idler roller 46 and a feed roller 44 on the feed roller shaft 43. The motor 41 indexes the leading edge of the paper into a print zone 29 beneath the print cartridge 28 where ink droplets are selectively ejected onto the media to form an image, which may include text and/or a picture. As the motor 41 continues to index the media M downstream toward the exit shaft 64, the media leading edge enters a nip 67 defined between the exit star wheel 66 and an exit roller 65 on the exit shaft 64. The motor 41 continues to index the media through the exit nip 47 by causing rotation of the exit gear 62. As the trailing edge of the media M reaches the feed nip 47 between the idler roller 46 and a feed roller 44, the media M does not incur media nip jump as typical in prior art devices. Instead, the torque of the elastic biasing member 50 on the exit damping hub 68 inhibits media nip jump caused by the spring force of the idler roller 46 on the feed roller 44. Alternatively stated, the engagement of the biasing member 50 on the hub 68 inhibits movement of the exit shaft 64 caused by a lateral force component on the media M by the idler roller 46. Thus, the motor 41 continues to index the media M by driving the exit gear 62 until the media advances to the output tray 24.

Figure 5:
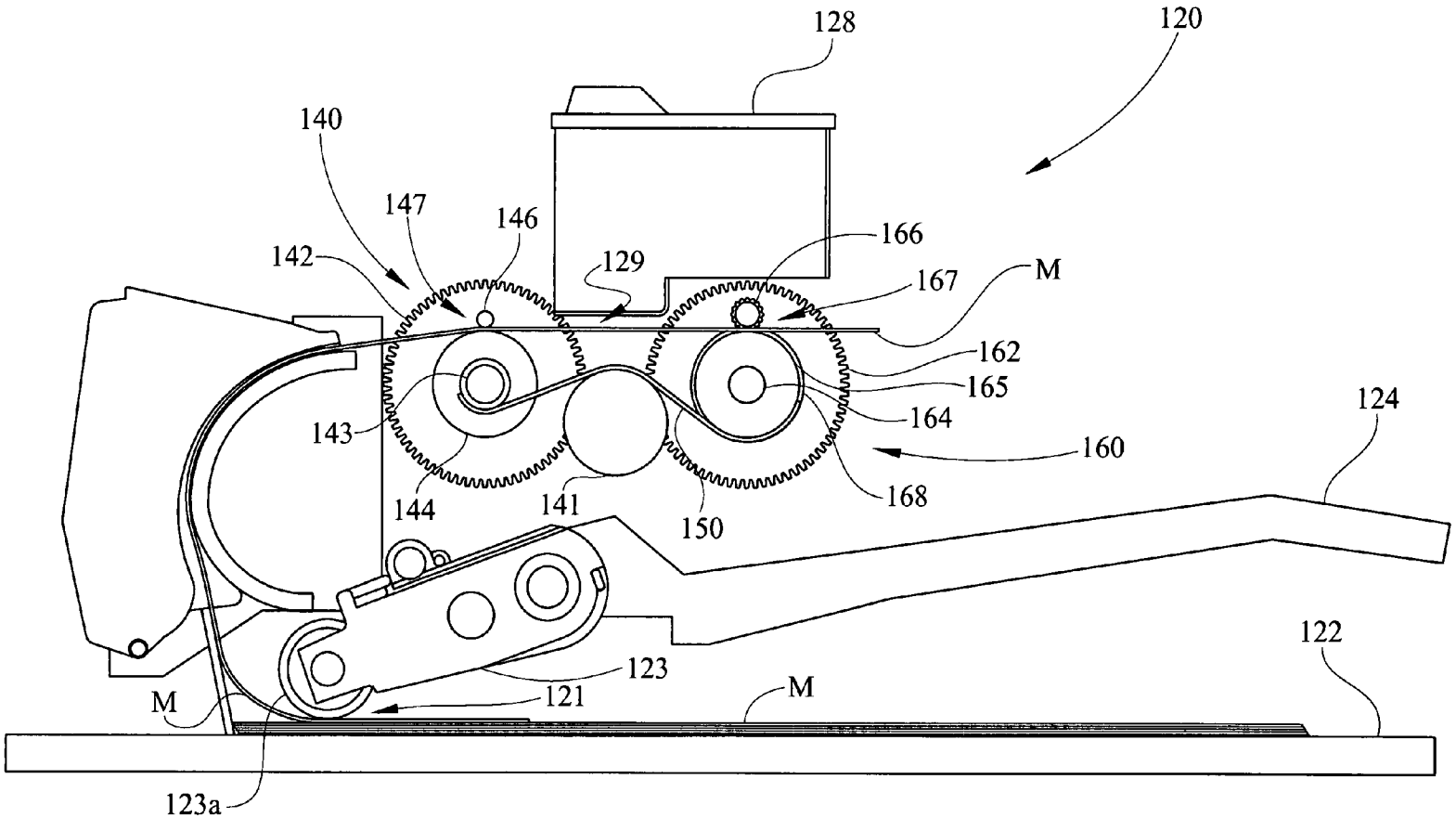
FIG. 5 is a side view of a C-shaped media feedpath having the dampener of FIG. 4.

Referring now to FIG. 5, a side view of an alternative print component 120 is depicted. The printing component 120 is a C-path printer meaning a media feedpath 121 is substantially C-shaped. The printing component 120 comprises an input tray 122 wherein a stack of media M is located for movement through the printing component 120 and for printing thereon. Above the input tray 122 is an output tray 124 where media M is stacked following printing. The media M is sequentially moved through the feedpath 121 until an image is fully printed on one or more media sheets. At a rear portion of the input tray 122 is an auto-compensating mechanism 123 comprising an inner gear transmission (not shown) and a driven roller **123*a* which directs an uppermost sheet M from the input tray and into the feedpath 121. Downstream along the feedpath 121 is a feed system 141 comprises feed shaft 143 connected to a feed gear 142 and comprises at least one feed roller 144. A motor 141 which drives, either directly or indirectly, the feed gear 142 at a preselected indexing speed to properly direct the media M through the print zone 129 beneath the print cartridge 128. Above the feed roller 144 is an idler roller 146, which defines a nip 147 with the feed roller 144 wherein media M is directed from the auto-compensating mechanism 123 and controlled for indexing through the print zone 129. The idler roller 146 is spring biased toward the feed roller 144 forming the nip 147** providing movement of the media M.

Opposite the feed gear 142 along the feedpath 121 is an exit system 160 comprising an exit gear 162 which is also driven, directly or indirectly, by the motor 141. The exit gear 162 is positioned on a rotatable exit shaft 164, which further comprises an exit hub 168 thereon. Also disposed along the exit shaft 164 are one or more exit rollers 165 which form a nip 167 with an exit star wheel 166. The exit star wheel 166 is biased toward the exit rollers 165 to form the media exit nip 167. The nip 167 receives media passing through the print zone 129 and continues to index the media from the printer component 120 to the output tray 124.

As described in the L-shaped feedpath embodiment, an elastic biasing member 150 extends from the feed shaft 143 to the exit hub 168 and over the motor 141. The elastic biasing member 150 comprises, as shown in FIG. 4, a thin strip of metal, or other elastic material, having first and second curvilinear ends 52, 54. Since the motor 141 is positioned linearly between the feed gear 142 and exit gear 162, the elastic member 150 must bend about the motor 141. When the elastic biasing member 150 is pressed against the feed roller 144 and exit hub 168, as well as bending around the motor 141, the biasing member 150 places a torque on the feed roller 144 and exit hub 168. The torque may vary based on the radius of the first and second curvilinear ends as well as the thickness of the biasing member 150.

In operation, the media M is directed from the input tray 122 by the auto-compensating mechanism 123 into the feedpath 121 of a C-shaped media feed path, an L-shaped shaped media feedpath or an auto-document feeding scanner. The motor 141 drives the auto-compensating mechanism 123 as well as the feed roller 144 and the exit shaft 164. As the media M moves through the C-shaped feedpath 121, the media M leading edge enters the feed nip 147. The motor 141 is controlled by a print controller (not shown) which indexes the media M through the feed nip 147, the print zone 129 and to the exit system 160. As the leading edge of media M reaches the exit system 160, the media M moves into the exit nip 167 between the exit star wheel 166 and the exit gear 162. When the trailing edge of media M passes the feed nip 147, the media exit system 160 continues indexing the media. However, the spring biased idler 146 which causes media nip jump and pushes the media forward in the feedpath 121, cannot force the media forward because the torque on the exit shaft 164 by the biasing member 150 inhibits unintended movement of the media M. Further, the application of torque by the biasing member 150 on the exit shaft 164 also inhibits rollback of the exit shaft 164. Thus, as the trailing edge of media M exits the feed nip 147, the biasing member 150 improves two sources of printing defects, i.e. media nip jump and exit shaft rollback. This structure and function provides improved results over prior art printers having printing defects such as banding and other defects.

Figure 6:
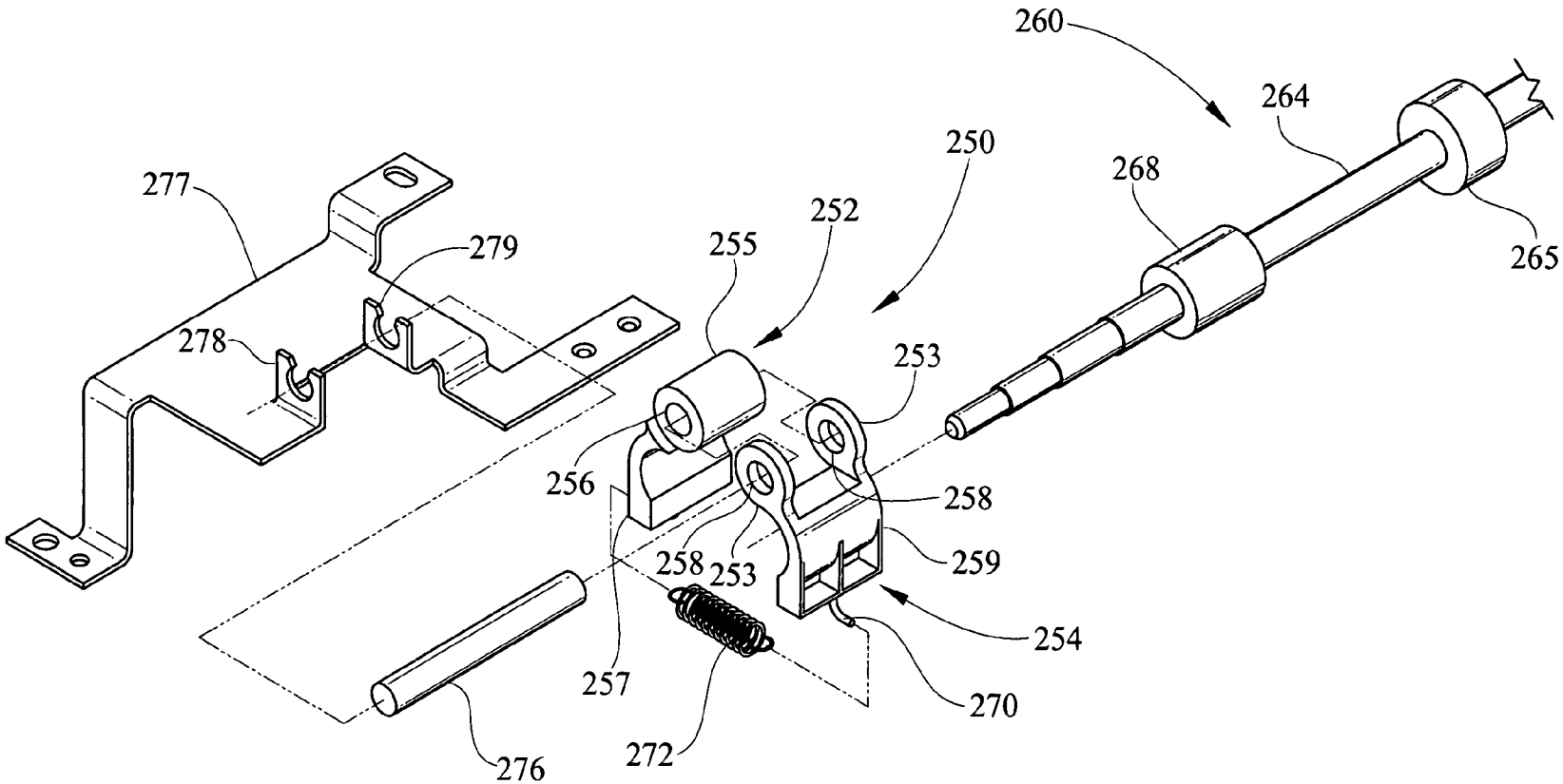
FIG. 6 is an exploded perspective view of an alternative damping assembly for a media feedpath.
Figure 7:
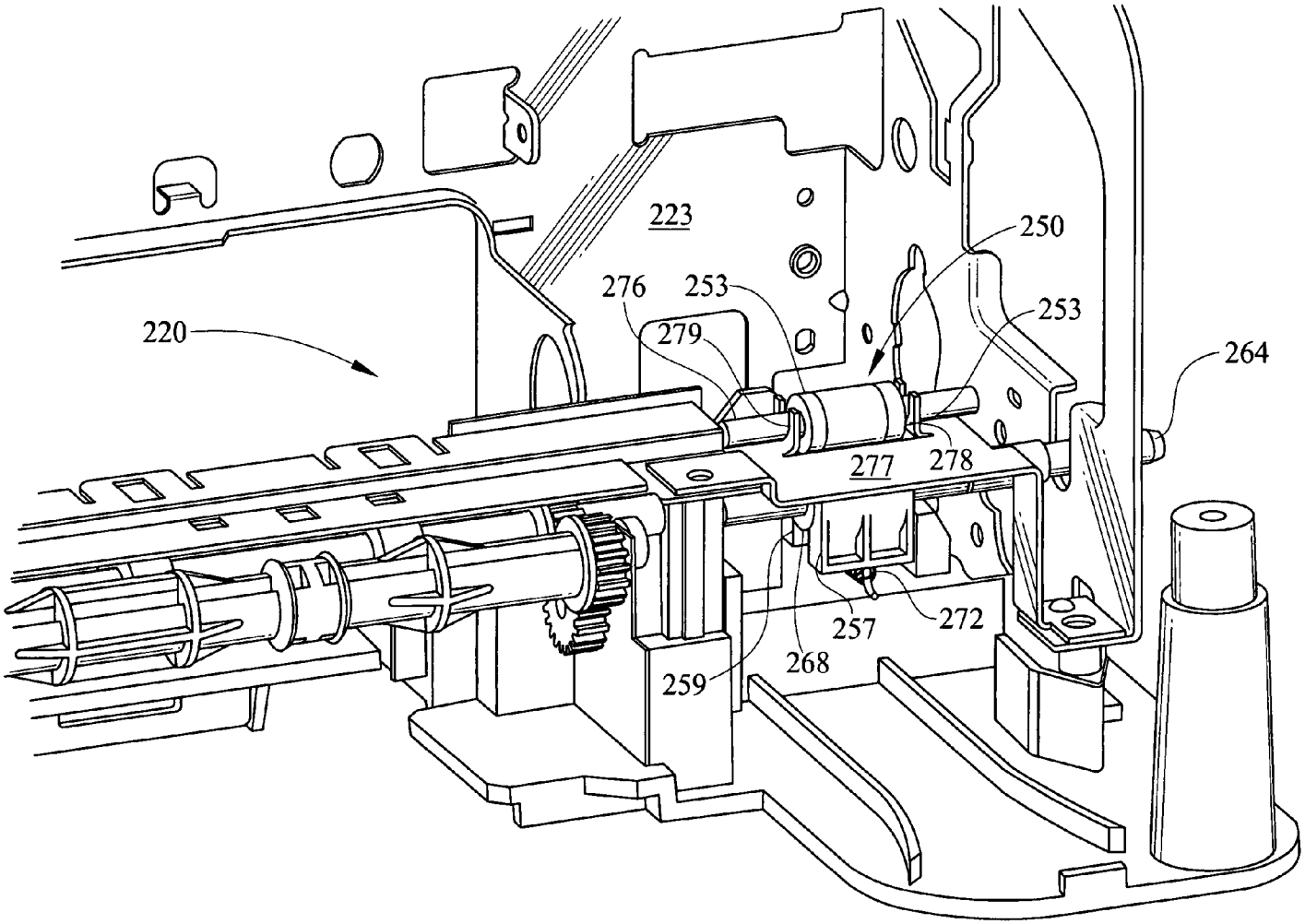
FIG. 7 is a perspective view of a printing component feedpath having the alternative damping assembly of FIG. 6; and, FIG. 8 is a side view of another exemplary alternative damping assembly embodiment along an L-shaped feedpath.

Referring now to FIGS. 6-7, an alternative embodiment of the present invention is depicted in exploded perspective view and a front perspective view, respectively. The alternative damping assembly 250 comprises an exit shaft 264 having both at least one exit roller 265 and a damping hub 268 concentrically positioned thereon. The damping hub 268 may be formed of POM or nylon. The exit shaft 264 is aligned with the damping assembly 250 so that the damping assembly 250 continuously frictionally engages the damping hub 268. Specifically, the damping assembly 250 comprises a first damping arm 252 and a second damping arm 254. The first and second damping arms 252, 254 may be formed of glass filled ABS or POM. The first damping arm 252 comprises a pivot cylinder 255 having a longitudinal aperture 256 extending through the pivot cylinder 255 and a brake 257 depending from the pivot cylinder 255. The second damping arm 254 comprises opposed pivot clasps 253, which each comprise a pivot aperture 258. The pivot cylinder 255 has a longitudinal length which is slightly less than the distance between the pivot clasps 253 so that the pivot cylinder 255 fits therebetween and the longitudinal aperture 256 is aligned with each pivot aperture 258. The second damping arm 254 further comprises a brake 259 which is opposite the brake 257 of the first damping arm 252. Each brake 257, 259 has a curvilinear shape defining a semi-circle wherein the damping hub 268 is positioned for assembly. The brakes 257, 259 each comprise a biasing arm 270 depending from a lowermost surface thereof. Each biasing arm 270 is connected by an elastic biasing member 272. In the instant exemplary embodiment, the elastic biasing member 272 is a coil spring and tensions the brakes 257, 259 toward one another and against the damping hub 268. As previously indicated, the torque on the damping hub 268 may vary due to the motor used, but according to the exemplary embodiment, the torque may be between about 0 and 10 inch-ounces of torque and preferably about 5 inch-ounces of torque. By varying the size of the elastic biasing member 272, the tension on each brake 257, 259 may be varied in order to vary force on the damping hub 268. Extending through the pivot clasps 253 and the pivot cylinder 255 is a dampener pivot pin 276. The dampener pivot pin 276 may be a plastic or metal cylindrical rod defining the pivot point for the brakes 257, 259 and has a length greater than the distance between pivot clasps 253. Adjacent the damping assembly 250 is a dampener retainer plate 277 which is fastened into the frame structure of the printer or all-in-one device, for example 10. The dampener retainer plate 277 maybe formed of sheet metal or other such thin lightweight, strong material. The dampener retainer plate 277 comprises opposed first and second pivot arms 278, 279 extending upward from a planer surface of the plate 277. The dampener pivot 276 has a length substantial enough to extend from each of the pivot clasps 253. Accordingly, each end of the dampener pivot 276 may be disposed in a corresponding pivot arm 278, 279 such that the damping assembly 250 pivotally depends from the dampener retainer plate 277.

In operation of the damping assembly 250 may be positioned along either an L-shaped media feedpath, a C-shaped media feedpath as previously described, or an auto-document document feeding scanner to substantially inhibit scanning defects. With the brakes 257, 259 extending about the damping hub 268 and the biasing member 272 extending between the arms 252, 254, a continuous frictional force is created between the damping hub 268 and the brakes 257, 259 when the exit shaft 264 rotates during media feeding. As the motor (not shown) rotates, the exit shaft 264 rotates in order to advance media M (FIGS. 3, 5) from a feed system (not shown) to the exit system 260. When the trailing edge of media M reaches the feed system, the media M cannot jump forward toward the exit system 260 because of the torque of the damping assembly 250 on the exit damping hub 268. Further, the exit shaft 264 cannot rotate unintentionally toward the feed system (not shown) because the frictional force also inhibits such movement. As a result, the printing defects such as banding are inhibited.

Figure 8:
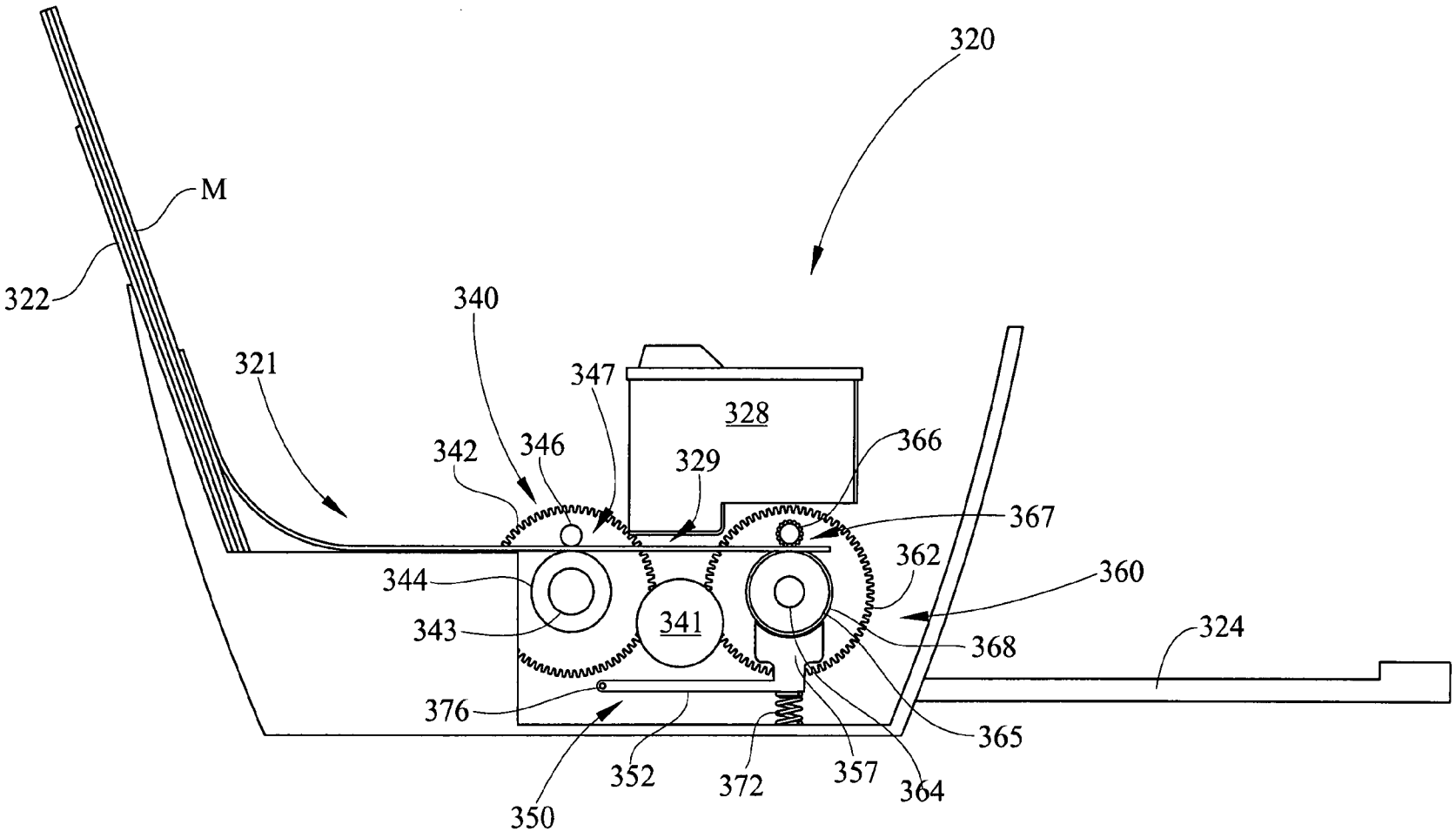

Referring now to FIG. 8, an alternative damping assembly 350 is depicted in a side view of a printing component 320. The printing component 320 comprises an input tray 322 and an output tray 324 defining a substantially L-shaped feedpath 321 which moves through the printing component 320. The printing component 320 further comprises at least one print cartridge 328 which selectively ejects ink droplets to each media sheet moving through a print zone 329 along the feedpath 321 and beneath the print cartridge 328. Alternatively, the damping assembly 350 may alternatively be utilized in a C-shaped media path, such as the one shown in FIG. 5.

Along the media feedpath 321 is a feed system 340 having a feed gear 342 connected to a rotatable feed shaft 343. The feed shaft 343 further comprises at least one feed roller 344 which rotates with the feed shaft 343 and forms a nip 347 with the idler roller 346 opposite the feed roller 344. The feed gear 342 is driven, either directly or indirectly, by a motor 341. Opposite the feed system 340 along the feedpath 321 is an exit system 360 comprising an exit gear 362 which is also driven, either directly or indirectly, by the motor 341. The exit gear 362 is connected to an exit shaft 364 which comprises a damping hub 368 thereon. Also located on exit shaft 364 is an exit roller 365 which rotates with the exit shaft 364 and forms an exit nip 367 with the star wheel 366 opposite the exit roller 365. The star wheel 366 is spring biased toward the exit roller 365 to index media from the print zone 329 to the output tray 324 along media path 321.

The feed nip 347 and exit nip 367 are substantially aligned so that the media M is directed through the print zone 329 beneath the print cartridge 328 by the feed roller 344 until the media M reaches the exit nip 367 which continues to pull the media M through the print zone after the trailing edge of the media M passes through the feed nip 347.

Extending from the frame or other fixed structure of the printing component 320 is a damping assembly 350 comprising a damping arm 352 which is pivotally connected at a first end at pivot 376 to the frame or other fixed structure within the printer 320. The damping arm 352 is biased at a second opposed end by an elastic biasing member 372. The exemplary elastic biasing member 372 is a coil spring which provides a continuous force on the damping arm 352 in the direction of damping hub 368. However, alternative devices may be substituted to provide a force on the damping arm 352. Also located at the second end of the damping arm 352 is a brake 357 having a curvilinear surface that engages the damping hub 368. The curvilinear surface of the brake 357 has a radius which corresponds to the radius of the damping hub 368 so that the two pieces are frictionally engaged along the outer surface of the damping hub 368 and the curvilinear brake surface. The elastic biasing member 372 provides a continuous upwardly directed force on the damping arm 352 and therefore provides a torque on the damping hub 368 and exit shaft 364. The continuous radial force causes friction between the hub 368 and brake 357 having a dampening effect on the exit shaft 364.

In operation, an upper most media sheet M is directed from the input tray 322 by media input means, such as an auto-compensating mechanism (FIG. 5). The media sheet M moves into the feedpath 321 toward the feed nip 347. As the leading edge of the media M reaches the feed nip 347, the media is driven by the feed roller 344 and moves through the print zone 329 beneath the print cartridge 328. The media M continues being indexed by the motor 341 until the leading edge reaches the exit nip 367. When the media M leading edge reaches the exit nip 367, the media M is pulled through the print zone by the exit roller 365 as well as the feed roller 344 until the trailing edge of the media M passes the feed nip 347. As the media trailing edge passes through the feed nip 347, the media M may be pushed forward slightly by the downward force of the idler roller 346 and the overdriving of the exit system 360. However, unlike prior art devices, the instant invention does not allow the unintended movement of the exit roller 365 and exit shaft 364 when the motor 341 is not rotating due to the torque on the damping hub 368 by the brake 357 and damping arm 352. Further, the torque on the damping hub 368 also inhibits the exit gear 362 from rolling backward due to forces on the media and therefore inhibits print defects such as banding which are problematic in prior art devices.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A damping assembly for a media feedpath, comprising:

a feedpath having a first shaft and a second shaft parallel and downstream from said first shaft;

a damping hub disposed on said second shaft;

a brake structure engaging said damping hub, the brake structure comprising:

a first damping arm and a second damping arm opposed to one another, the first damping arm and the second damping arm substantially enclosing an outer surface of said damping hub, said first and second damping arms pivotally connected at a respective end thereof; and a biasing member engaging said first damping arm and second damping arm at a respective other end of said first and second damping arms to rotatably engage said first and second damping arms with said damping hub to dampen unintended movement of said second shaft during media feed.

2. The damping assembly of claim 1 further comprising a dampener pivot disposed adjacent said brake structure.

3. The damping assembly of claim 2 wherein said damping arms are pivotally connected to said dampener pivot.

4. The damping assembly of claim 1, wherein said first damping arm comprises a first brake and said second damping arm comprises a second brake, each of said first brake and second brake substantially enclosing the outer surface of said damping hub wherein said biasing member engages said first and second brakes to bias said first and second brakes toward one another.

* * * * *